US006605167B1

(12) United States Patent
Blomquist

(10) Patent No.: US 6,605,167 B1
(45) Date of Patent: Aug. 12, 2003

(54) AUTOIGNITION MATERIAL FOR A VEHICLE OCCUPANT PROTECTION APPARATUS

(75) Inventor: Harold R. Blomquist, Gilbert, AZ (US)

(73) Assignee: TRW Inc., Lyndhurst, OH (US)

( * ) Notice: Subject to any disclaimer, the term of this patent is extended or adjusted under 35 U.S.C. 154(b) by 0 days.

(21) Appl. No.: 09/654,420

(22) Filed: Sep. 1, 2000

(51) Int. Cl.[7] ..... C06B 45/32

(52) U.S. Cl. ..... 149/7; 149/5; 149/37; 149/114

(58) Field of Search ..... 149/5–7, 37, 114

(56) References Cited

U.S. PATENT DOCUMENTS

| | | | | |
|---|---|---|---|---|
| 845,678 A | * | 2/1907 | Bayliss | 149/7 |
| 2,333,275 A | * | 11/1943 | Snelling | 149/7 |
| 2,954,284 A | * | 9/1960 | Toulmin | 149/6 |
| 3,133,841 A | * | 5/1964 | Kuehl | 149/5 |
| 3,834,256 A | * | 9/1974 | Fox et al. | 149/7 |
| 3,834,955 A | * | 9/1974 | Fox et al. | 149/7 |
| 3,953,256 A | * | 4/1976 | Schwarz et al. | 149/5 |
| 4,367,103 A | * | 1/1983 | Enever | 149/7 |
| 4,881,994 A | * | 11/1989 | Rudy et al. | 149/20 |
| 5,439,537 A | | 8/1995 | Hinshaw et al. | |
| 5,468,313 A | * | 11/1995 | Wallace et al. | 149/53 |
| 5,542,688 A | * | 8/1996 | Scheffee | 149/19.1 |
| 5,739,460 A | | 4/1998 | Knowlton et al. | |
| 5,792,982 A | | 8/1998 | Scheffee | |
| 5,936,195 A | * | 8/1999 | Wheatley | 149/19.91 |
| 5,959,242 A | | 9/1999 | Knowlton et al. | |
| 6,430,920 B1 | * | 8/2002 | Martin et al. | 60/255 |
| 6,454,886 B1 | * | 9/2002 | Martin et al. | 149/2 |
| 6,503,350 B2 | * | 1/2003 | Martin et al. | 149/37 |

FOREIGN PATENT DOCUMENTS

| | | |
|---|---|---|
| DE | 3841690 A1 | 6/1990 |
| DE | 19548544 A1 | 6/1997 |
| DE | 19616628 A1 | 11/1997 |
| DE | 69316530 T1 | 5/1998 |
| DE | 69423631 T2 | 11/2000 |
| EP | 0715576 B1 | 6/1996 |

* cited by examiner

*Primary Examiner*—Edward A. Miller
(74) *Attorney, Agent, or Firm*—Tarolli, Sundheim, Covell & Tummino L.L.P.

(57) ABSTRACT

An autoignition material includes a plurality of agglomerates. Each agglomerate comprises an oxidizer material particle. A plurality of metal fuel particles are disposed on the oxidizer material particle. The metal fuel particles are present in a weight ratio effective to substantially stoichiometrically balance the oxidizer material particle. The metal fuel particles exothermically react with the oxidizer material particle when the autoignition material is exposed to a temperature of about 80° C. to about 250° C. A thin binder film adheres the metal fuel particles to the oxidizer material particle and maintains the metal fuel particles in intimate contact with the oxidizer particle.

21 Claims, 1 Drawing Sheet

AUTOIGNITION MATERIAL FOR A VEHICLE OCCUPANT PROTECTION APPARATUS

FIELD OF THE INVENTION

The present invention relates to an apparatus for inflating an inflatable vehicle occupant protection device and, more particularly, to an autoignition material for a vehicle occupant protection apparatus.

BACKGROUND OF THE INVENTION

An inflatable vehicle occupant protection device, such as an air bag, is deployed upon the occurrence of a vehicle crash. The air bag is part of a vehicle occupant protection apparatus, which further includes a crash sensor and an inflator. The inflator includes a housing, a gas generating material in the housing, and an igniter. The igniter is actuated so as to ignite the gas generating material when the vehicle experiences a collision for which inflation of the air bag is desired to protect the vehicle occupant. As the body of gas generating material burns, it generates a volume of inflation gas. The inflation gas is directed into the air bag to inflate the air bag. When the air bag is inflated, it expands into the vehicle occupant compartment and helps to protect the vehicle occupant.

Inflator housings may be formed from lightweight materials, such as aluminum. These lightweight materials can lose strength at abnormally high temperatures, such as those reached in a vehicle fire. At temperatures experienced in a vehicle fire, the gas generating material may autoignite and produce an inflation gas. The pressure of the inflation gas can cause the inflator housing to lose its structural integrity due to the reduced strength of the inflator housing material. To prevent such loss of structural integrity, inflators typically include an autoignition material that will autoignite and initiate combustion of the gas generating material at a temperature below that at which the material of the housing begins to lose a significant percentage of its strength.

U.S. Pat. No. 5,959,242 discloses an autoignition composition for safely initiating combustion of a main pyrotechnic charge in a gas generator or pyrotechnic device exposed to flame or a high temperature environment. The autoignition composition includes an oxidizer composition and metal powder.

SUMMARY OF THE INVENTION

The present invention is an autoignition material of a plurality of agglomerates. Each agglomerate comprises an oxidizer material particle. A plurality of metal fuel particles are disposed on the oxidizer material particle. The metal fuel particles are present in a weight ratio effective to substantially stoichiometrically balance the oxidizer material particle. The metal fuel particles exothermically react with the oxidizer material particle when the autoignition material is exposed to a temperature of about 80° C. to about 250° C. A thin binder film adheres the metal fuel particles to the oxidizer material particle and maintains the metal fuel particles in intimate contact with the oxidizer particle.

BRIEF DESCRIPTION OF THE DRAWINGS

Further features of the present invention will become apparent to those skilled in the art to which the present invention relates from reading the following description with reference to the accompanying drawings, in which.

DESCRIPTION OF A PREFERRED EMBODIMENT

Figure 1:
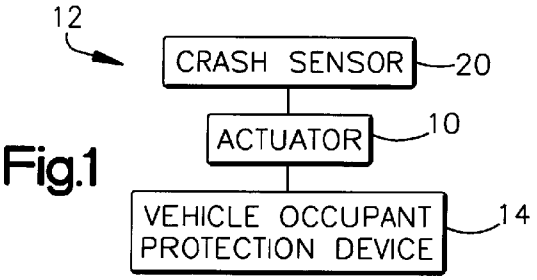
FIG. 1 is a schematic view of a vehicle occupant protection apparatus including an inflator constructed in accordance with the present invention.

As representative of the present invention, FIG. 1 illustrates schematically a vehicle occupant protection apparatus 12. The apparatus 12 includes a vehicle occupant protection device 14. In one embodiment of the invention, the vehicle occupant protection device 14 is an air bag. Other vehicle occupant protection devices that can be used in accordance with the present invention are, for example, inflatable seat belts, inflatable knee bolsters, inflatable head liners, inflatable side curtains, knee bolsters operated by inflatable air bags, and seat belts actuated by seat belt pretensioners.

The apparatus 12 comprises an actuator 10. The actuator 10 comprises an igniter 16. The igniter 16 is electrically actuatable to ignite a gas generating material 18 (FIG. 2) contained within the actuator 10. Combustion of the gas generating material 18 produces a combustion gas that actuates the vehicle occupant protection device 14. When the vehicle occupant protection device 14 is actuated, it helps to protect a vehicle occupant from a forceful impact with parts of the vehicle as a result of a crash.

The apparatus 12 also includes a crash sensor 20. The crash sensor 20 is a known device that senses a vehicle condition, such as sudden vehicle deceleration, indicative of a collision or rollover. The crash sensor 20 measures the magnitude and duration of the deceleration. If the magnitude and duration of the deceleration meet or exceed predetermined threshold levels, the crash sensor 20 transmits a signal or causes a signal to be transmitted to actuate the actuator 10.

In the one embodiment of the present invention, the actuator 10 is a pyrotechnic inflator for producing gas to inflate an air bag. The actuator 10, however, could be a gas generator for a seat belt pretensioner (not shown), or a hybrid air bag inflator (not shown).

Figure 2:
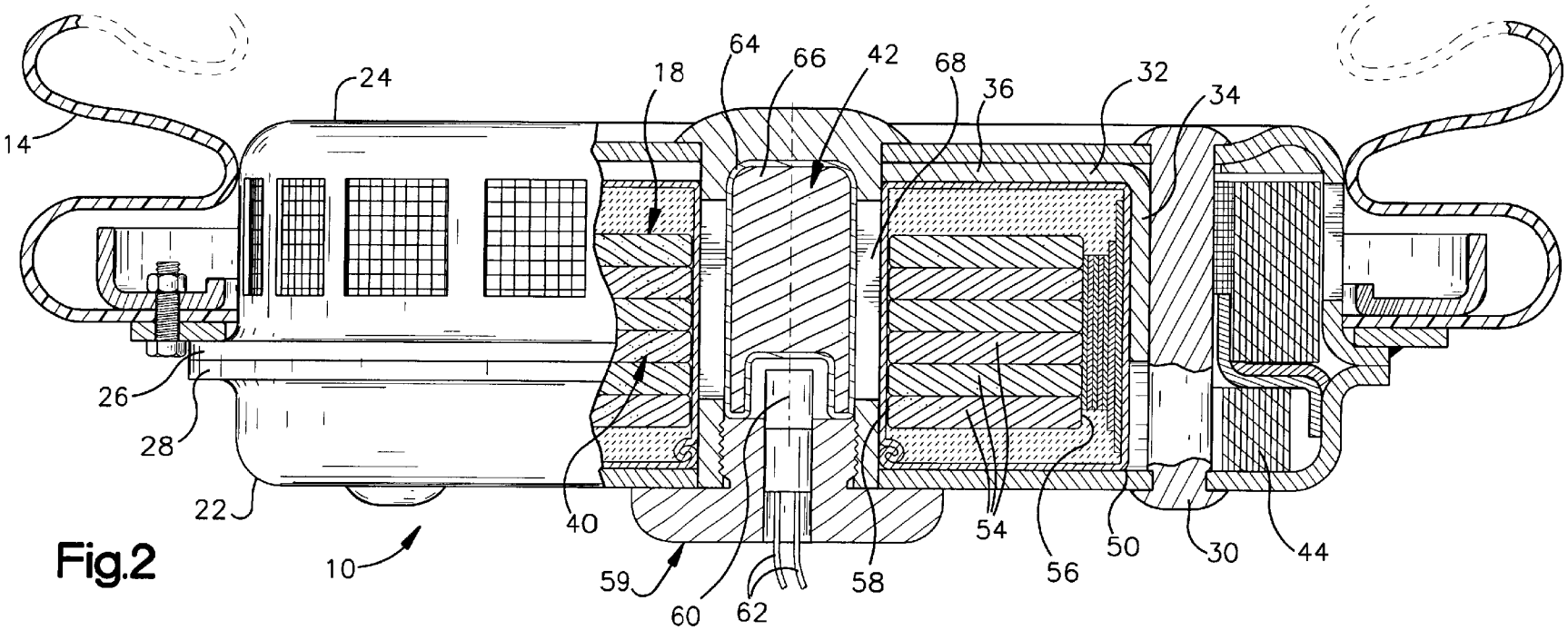
FIG. 2 is an enlarged, sectional view showing the inflator of FIG. 1.

The specific structure of the inflator 10 can vary. Referring to FIG. 2, the inflator 10 comprises a base section 22 and a diffuser section 24. The two sections 22 and 24 are joined together at mounting flanges, 28 and 26, which are attached to each other by a continuous weld (not shown). A plurality of rivets 30 also hold the diffuser section 24 and the base section 22 together.

A combustion cup 32 is seated between the diffuser section 24 and the base section 22. The combustion cup 32 comprises an outer cylindrical wall 34 and an annular top wall 36. The combustion cup 32 divides the inflator 10 into a combustion chamber 40, which is located within the combustion cup 32, and a filtration chamber 44, which is annular in shape and is located outside the combustion cup 32.

The combustion chamber 40 houses an inner container 50, which is hermetically sealed. The inner container 50 holds gas generating material 18, which is in the form of a plurality of gas generating disks 54. The gas generating disks 54 have a generally toroidal configuration with a cylindrical exterior surface 56 and an axially extending hole defined by a cylindrical interior surface 58. The disks 54 are positioned in the container in a stacked relationship with the axially extending holes in alignment. Each disk 54 has generally flat opposed surfaces and may have protuberances on such surfaces to space one disk slightly from another. This configuration of the disks 54 promotes a uniform combustion of the disks 54. The gas generating material could, alternatively, be provided in the form of pellets or tablets.

The cylindrical interior surfaces 58 of the disks 54 encircle an ignition chamber 42. The ignition chamber 42 is defined by a two-piece, tubular igniter housing 59 that fits within the combustion cup 32 and the disks 54 and contains a squib 60. The squib 60 contains a small charge of ignitable material (not shown). Electric leads 62 convey a current to the squib 60. The current is provided when the crash sensor 20, which is responsive to a condition indicative of a vehicle collision, closes an electrical circuit that includes a power source (not shown). The current generates heat in the squib 60 that ignites the ignitable material.

The ignition chamber 42 also has a canister 64 that contains an autoignition material 66. The autoignition material 66 is in the form of a compacted powder. The autoignition material 66 generates, upon ignition, heat and combustion products. The heat and combustion products rupture the canister 64 and exit from the ignition chamber 42 through openings 68 in the igniter housing 59 that lead to the combustion chamber 40. The heat and combustion products of the autoignition material 66 penetrate the container 50 and ignite the gas generating material 18.

The autoignition material 66 is ignited by the small charge of ignitable material of the squib 60. The autoignition material 66 will also spontaneously ignite at a predetermined temperature. The predetermined temperature is below the temperature at which the inflator 10 begins to lose structural integrity and below the temperature at which the gas generating material 18 normally autoignites. Preferably, the predetermined temperature at which the autoignition material autoignites is between about 80° C. and about 250° C.

In accordance with the present invention, the autoignition material 66 comprises agglomerates of an oxidizer material, a metal fuel, and a binder.

The oxidizer material of the present invention includes at least one inorganic salt oxidizer, organic salt oxidizer, or a combination thereof. Preferred inorganic salt oxidizers are alkali metal nitrates, alkali metal nitrites, alkali metal chlorates, alkali metal perchlorates, alkaline earth metal nitrates, alkaline earth metal nitrites, alkaline earth metal chlorates, alkaline earth metal perchlorates, ammonium perchlorate, complex salt nitrates such as ceric ammonium nitrate ($Ce(NH_4)_2(NO_3)_6$) or zirconium oxide dinitrate ($ZrO(NO_3)_2$), silver nitrate, silver nitrite, and combinations thereof. Preferred organic salt oxidizers are solid organic nitrates ($R—(ONO_2)_x$), solid organic nitrites ($R—(NO_2)_x$), solid organic amines ($R—(NH_2)_x$) and combinations thereof.

When more than one oxidizer is used in the autoignition material, the oxidizers may be provided as either a comelt or a mixture. When provided as a comelt, the comelt is a eutectic and/or a peritectic that melts in the range of about 80° C. to about 250° C. When provided as a mixture, the mixture should preferably produce, when heated, a eutectic and/or a peritectic that melts in the range of about 80° C. to about 250° C.

One preferred oxidizer material for use in the autoignition material of the present invention is a comelt of silver nitrate and an oxidizer selected from the group consisting of alkali metal or alkaline earth metal nitrates, nitrites, chlorates, and perchlorates. Another preferred oxidizer material is a mixture of silver nitrate and an oxidizer selected from the group consisting of solid organic nitrates, solid organic nitrites, and solid organic amines.

The oxidizer material of the present invention may further comprise an alkali metal or alkaline earth metal chloride, fluoride, or bromide. The alkali metal or alkaline earth metal chloride, fluoride, or bromide is comelted with a nitrate, nitrite, chlorate or perchlorate oxidizer material of the present invention. This has the effect of reducing the melting point of the oxidizer material or the temperature at which the oxidizer material exhibits a phase change.

The oxidizer material is incorporated in the autoignition material in the form of particles. The average particle size of oxidizer material is less than about 100 microns. Preferably, the average particle size of the oxidizer material is from about 10 microns to about 30 microns.

The metal fuel of the autoignition material is any metal fuel that exothermically reacts with the oxidizer material upon exposure of the autoignition material to a temperature of about 80° C. to about 250° C. A preferred metal fuel is a metal substantially removed in the electromotive or activity series from the metal or metals of the oxidizer. A preferred metal is selected from the group consisting of molybdenum, magnesium, manganese, chromium, iron, cobalt, nickel, titanium, zirconium, vanadium, niobium, tantalum, copper, zinc, cadmium, tin, antimony, bismuth, aluminum, and silicon. These metal fuels may be used alone or in combination. The most preferred metal fuel is molybdenum.

The metal fuel is incorporated in the autoignition material in the form of a powder. The average particle size of the powder metal fuel is substantially smaller than the average particle size of the oxidizer material. The average particle size of the powder metal fuel is less than about 10 microns. Preferably, the average particle size of the powder metal fuel is from about 0.1 micron to about 5 microns.

The metal fuel must be maintained in intimate contact with the oxidizer material to react exothermically with the oxidizer material and ensure ignition of the autoignition material upon exposure of the autoignition material to a temperature of about 80° C. to about 250° C. By intimate contact, it is meant that the particles of metal fuel and the particles of oxidizer are sufficiently close to one another to react exothermically upon exposure of the autoignition material to a temperature of about 80° C. to about 250° C.

The mechanism believed to be involved in the autoignition of the oxidizer and the metal fuel is disclosed in U.S. Pat. No. 5,959,242.

For example, the reaction of an autoignition material comprising a comelt of metal nitrates and a metal proceeds according to the general equation $$(\text{Metal}_1\text{Nitrate}+\text{Metal}_2\text{Nitrate})_{(comelt)}+\text{Metal}_3\rightarrow\text{Metal}_1\text{Oxide}+\text{Metal}_2\text{Oxide}+\text{Metal}_3\text{Oxide}+\text{Nitrogen} \quad (\text{I})$$

The driving force for this reaction appears to follow the activity series or electromotive series for metals, in which metallic elements higher in the series will displace, i.e., reduce, elements lower in the series from a solution or melt. In particular, oxidizer systems containing silver nitrate and/or silver nitrite will generally yield very efficient autoignition materials with respect to ease, rate, and intensity of reaction when compounded with metals that are high in the activity of electromotive series. For example, magnesium (Mg), aluminum (Al), manganese (Mn), zinc (Zn), chromium (Cr), iron (Fe), cadmium (Cd), cobalt (Co), nickel (Ni), and molybdenum (Mo) are all well above silver (Ag) in the series. A typical reaction is represented by equations II to V.

$$2AgNO_3+Mg\rightarrow 2Ag+Mg(NO_3)_2 \quad (\text{II})$$

In the high temperature, molten salt environment after ignition is initiated, neither the $Mg(NO_3)_2$ nor the Ag metal are stable, and a second reaction quickly occurs to produce metal and nitrogen oxides:

$$2Ag+Mg(NO_3)_2 \rightarrow Ag_2O+MgO+2NO_2 \quad \text{(III)}$$

When potassium nitrate is also present in the comelt, the following reaction occurs.

$$9Mg+2KNO_3+10Mg \rightarrow Ag_2O+K_2O+10MgO+2N_2 \quad \text{(IV)}$$

Summing equations II, III, and IV, yields a net reaction that was given in general terms as equation I. For a composition of silver nitrate, potassium nitrate, and magnesium, the net reaction is $$2AgNO_3+2KNO_3+10Mg \rightarrow Ag_2O+K_2O+10MgO+2N_2 \quad \text{(V)}$$

A comparison of Differential Scanning Calorimeter (DSC) and Calibrated Tube Furnace autoignition test results, for inorganic, organic, and mixed inorganic/organic nitrate, nitrite, chlorate, and perchlorate oxidizer systems with selected metals, demonstrates that at least two different autoignition mechanisms may be involved. As described above, purely inorganic systems, e.g., $KNO_3/AgNO_3/Mo$, generally autoignite in the vicinity of a thermal event clearly visible on a DSC scan, such as a crystalline phase transition, a melting point, or a eutectic or peritectic point. In some of the organic and mixed inorganic/organic systems, it appears that autoignition of larger mass samples in the tube furnace can occur at much lower temperature than autoignition in the DSC without the presence of some small, lower temperature thermal event observed on the DSC. For example, the $CH_6N_4O_3/AgNO_3/Mo$ system autoignites at 170–174° C. with no thermal events prior to autoignition. However, a 200 mg sample of the same composition autoignites in the tube furnace at 138–158° C., depending on percent composition. It is possible that this more than just a mass effect. The dramatic reduction in the autoignition temperatures observed in tube furnace testing, as compared to the results obtained with DSC testing, is possibly the result of some catalytic, self heating, or other thermal effect.

The amount of the nitrate, nitrite, chlorate, or perchlorate used in an autoignition composition can vary significantly. For purely inorganic oxidizer material, the mole percent or molar ratio of the nitrate, nitrite, chlorate, or perchlorate oxidizer components in binary and ternary mixes and comelts should be stoichiometrically balanced with the metal or metals in the final autoignition composition. In other words, the molar amounts of the oxidizer material and the metal fuel should be substantially proportional to the molar amounts given in the balanced chemical equation for the reaction of the oxidizer material with the metal fuel. It appears, however, that the autoignition temperature for organic/inorganic oxidizer material utilized in autoignition materials comprising molybdenum metal can be tailored by adjusting the molybdenum metal content from stoichiometrically balanced to extremely metal (fuel) rich. As the molybdenum metal content is increased, the autoignition temperature decreases. It is believed that this holds true for the other metal fuels described above.

The amount of each oxidizer component in a mixture or comelt depends on the molar amounts of the oxidizers at or near the eutectic point for the specific oxidizer mixture or comelt composition. As a result, the nitrate, nitrite, chlorate, or perchlorate oxidizer component or components will be the major component in some autoignition compositions of the invention, and the powdered metal fuel will be the major component in others. Those skilled in the art will be able to determine the required amount of each component from the stoichiometry of the autoignition reaction or by routine experimentation.

The autoignition material of the present invention further includes a binder. The binder is present in the autoignition material as a thin film or on pre-agglomerate particles of oxidizer and metal fuel. The binder causes the smaller particles of metal fuel to adhere to the larger particles of oxidizer material and maintains the particles of metal fuel in intimate contact with the particles of oxidizer material.

The binder of the present invention can be any thermoplastic or thermosetting binder. Preferred binders include cellulose acetate butyrate, polycarbonate, polyurethanes, polyesters, polyethers, polysuccinates, thermoplastic rubbers, polybutadienes, polystyrene, and mixtures thereof. A preferred thermoplastic binder is KRATON (trademark), a polyethylene/butylene-polystyrene block copolymer manufactured by Shell Chemical Company.

The amount of binder present in the autoignition material is the minimal amount of binder effective to provide a thin film around the pre-agglomerated particles of particulate oxidizer material and metal fuel so as to maintain the metal fuel in intimate contact with the aparticulate oxidizer material during storage of the autoignition material in the vehicle occupant protection apparatus. A preferred amount of binder is from about 0.1% by weight to about 1.5% by weight based on the weight of the oxidizer material and the metal fuel. An amount of binder in excess of about 1.5% by weight can potentially desensitize the autoignition material by inhibiting intimate contact of the particles of metal fuel with the particles of oxidizer material. An amount of binder less than about 0.1% is insufficient to maintain intimate contact of the particles of metal fuel with the particles of oxidizer material when the autoignition material is vibrated as a result of normal vehicle operation. More preferably, the amount of binder is about 0.3% by weight of the autoignition material.

In accordance with the present invention, the particles of oxidizer material, metal fuel, and binder are formed into agglomerates. The particles of metal fuel and oxidizer material are mixed using conventional powder mixing methods. The smaller particles of metal fuel, during mixing, adhere to the larger oxidizer particles by electrostatic attraction and form pre-agglomerates with the particles of oxidizer material. The pre-agglomerates comprise a larger number of particles of the smaller metal fuel disposed on the individual particles of the larger oxidizer material in the desired weight ratio.

The pre-agglomerates of metal fuel and oxidizer material are then coated with the binder. The pre-agglomerates of metal fuel and oxidizer material are coated with the binder by mixing the pre-agglomerates with a dilute solution of the binder material and a solvent. The dilute solution is prepared by mixing the binder with a solvent. The solvent can be any solvent that at least partially dissolves the binder, but does not dissolve the oxidizer material or metal fuel. Preferred solvents are organic solvents such as methylene chloride, toluene, ethyl acetate, and amyl acetate. The pre-agglomerates of metal fuel and oxidizer material are mixed with the dilute solution of binder material using a low sheer agitation mixer such as a vertical blade mixer.

Once the pre-agglomerates of metal fuel and oxidizer material have been thoroughly mixed with the binder solution, the solvent is evaporated using known drying techniques such as spray drying or fluidized bed drying. The binder provides a thin film on the pre-agglomerates of metal fuel and oxidizer material that coats and encapsulates the pre-agglomerates of metal fuel and oxidizer material. The binder film causes the metal fuel to adhere to the oxidizer material and maintains the metal fuel in intimate contact with the oxidizer material.

The agglomerates of autoignition material so formed have the consistency of a free flowing powder. The agglomerate particles have an average particle size of about 20 microns to about 200 microns. The agglomerate particles of autoignition material preferably have an average particle size of about 50 microns.

The agglomerate particles of autoignition material can be pressed into the configuration of the autoignition material of FIG. 2 or into some other configuration.

Upon exposure of the agglomerate particles of autoignition material to a temperature of about 80° C. to 250° C., the oxidizer material undergoes a phase change. The phase change provides a kinetically favorable environment for the exothermic reaction of the particles of metal with the particles of oxidizer material. As a result, the particles of metal fuel react with the particles of oxidizer material. The exothermic reaction produces an amount of heat and ignition products sufficient to initiate combustion of the gas generating charge.

From the above description of the invention, those skilled in the art will perceive improvements, changes and modifications in the invention. Such improvements, changes and modifications within the skill of the art are intended to be covered by the appended claims.

Having described the invention, the following is claimed:

1. An autoignition material of a plurality of agglomerates, each agglomerate comprising:

an oxidizer material particle;

a plurality of metal fuel particles disposed on the oxidizer material, the average particle size of the metal fuel particles being substantially less than the average particle size of the oxidizer material particle, the metal fuel particles being substantially less than the average particle size of the oxidizer material particle, the metal fuel particles being present in a weight ratio effective to substantially stoichiometrically balance the oxidizer material particle and exothermically reacting with the oxidizer material particle when the autoignition material is exposed to a temperature of about 80° C. to about 250° C.; and a thin binder film being present in an amount of about 0.1% to about 1.5% by weight based on the combined weight of the metal fuel and oxidizer material, said thin binder film being effective to adhere the metal fuel particles to the oxidizer material particle and maintain the metal fuel particles in intimate contact with the oxidizer material particle.

2. The autoignition material of claim 1 wherein the oxidizer material particle has an average particle size in the range of a about 10 microns to about 100 microns and the metal fuel particles have an average particle size in the range of about 1 micron to about 5 microns.

3. The autoignition material of claim 2 wherein the binder film coats and encapsulates the oxidizer material particle and the metal fuel particles.

4. The autoignition material of claim 3 prepared by the method comprising:

a) preparing pre-agglomerated particles of oxidizer material particles and metal fuel particles adhered to the oxidizer material particles;

b) preparing a dilute solution of a binder and a solvent;

c) mixing the solution of step b) with pre-agglomerated particles of step a); and d) evaporating said solvent to obtain a thin binder film coating and encapsulating the pre-agglomerated particles.

5. The autoignition material of claim 2, wherein the oxidizer material comprises an oxidizer selected from the group consisting of alkali metal nitrates, alkali metal nitrites, alkali metal chlorates, alkali metal perchlorates, alkaline earth metal nitrates, alkaline earth metal nitrites, alkaline earth metal chlorates, alkaline earth metal perchlorates, complex salt nitrites, complex salt nitrates, ammonium perchlorate, silver nitrate, silver nitrite, solid organic nitrates, solid organic nitrites, mixtures thereof and comelts thereof.

6. The autoignition material of claim 5 further comprising an alkali metal or alkaline earth metal chloride, fluoride, or bromide comelted with the oxidizer material.

7. The autoignition material of claim 1 wherein the oxidizer is a comelt of silver nitrate and an alkali metal or alkaline earth metal nitrate nitrite, chlorate, or perchlorate.

8. The autoignition material of claim 7 wherein the metal fuel is molybdenum.

9. The autoignition material of claim 1 wherein the oxidizer is a mixture of silver nitrate and a solid organic nitrate, solid organic nitrite.

10. The autoignition material of claim 9 wherein the metal fuel is molybdenum.

11. An autoignition material for initiating combustion of a main gas generating material in a gas generator or pyrotechnic device exposed to a flame or a high temperature environment consisting essentially of:

a particulate metal fuel, a binder, and a particulate oxidizer material selected from the group consisting of alkali metal nitrates, alkali metal nitrites, alkali metal chlorates, alkali metal perchlorates, alkaline earth metal nitrates, alkaline earth metal nitrites, alkaline earth metal chlorates, alkaline earth metal perchlorates, complex salt nitrites, complex salt nitrates ammonium perchlorate, silver nitrate, silver nitrite, solid organic nitrates, solid organic nitrites, mixtures thereof, and comelts thereof;

said particulate metal fuel being present in a weight ratio effective to substantially stoichiometrically balance the oxidizer material particle and exothermically reacting with the oxidizer material particle when the autoignition material is heated to a temperature of about 80° C. to about 250° C., said particulate metal fuel being in intimate contact with said particulate oxidizer material; and said binder being present in an amount of about 0.1% to about 1.5% by weight based on the combined weight of the metal fuel and oxidizer material, said binder being effective to maintain the particulate metal fuel in intimate contact with the particulate oxidizer material when the autoignition material is vibrated.

12. The autoignition material of claim 11 wherein the oxidizer material has an average particle size in the range of about 10 microns to about 100 microns and the metal fuel has an average particle size in the range of about 1 micron to about 5 microns.

13. The autoignition material of claim 12 wherein the particulate metal fuel is disposed on the particulate oxidizer material.

14. The autoignition material of claim 13 wherein the binder film coats and encapsulates the particulate oxidizer material and the particulate metal fuel.

15. The autoignition material of claim 11 wherein the oxidizer material is a comelt of silver nitrate and an alkali metal or alkaline earth metal nitrate nitrite, chlorate, or perchlorate.

16. The autoignition material of claim 15 wherein the metal fuel is molybdenum.

17. The autoignition material of claim 11 wherein the oxidizer is a mixture of silver nitrate and a solid organic nitrate or solid organic nitrite.

18. The autoignition material of claim 17 wherein the metal fuel is molybdenum.

19. An autoignition material of a plurality of agglomerates, each agglomerate consisting essentially of;

an oxidizer material particle, the oxidizer material being selected from the group consisting of alkali metal nitrates, alkali metal nitrites, alkali metal chlorates, alkali metal perchlorates, alkaline earth metal nitrates, alkaline earth metal nitrites, alkaline earth metal chlorates, alkaline earth metal perchlorates, complex salt nitrites, complex salt nitrates, ammonium perchlorate, silver nitrate, silver nitrite, mixtures thereof and comelts thereof;

a plurality of molybdenum fuel particles having an average particle size substantially smaller than the average particle size of the oxidizer material particle, the molybdenum fuel particles being disposed on the oxidizer material particle, the molybdenum fuel particles being present in a weight ratio effective to substantially stoichiometrically balance the oxidizer material particle and exothermically reacting with the oxidizer material particle when the autoignition material is exposed to a temperature of about 80° C. to about 250° C.; and a thin binder film being present in an amount of about 0.1% to about 1.5% by weight based on the combined weight of the metal fuel and oxidizer material, said thin binder film being effective to adhere the molybdenum fuel particles to the oxidizer material particle and maintain the molybdenum fuel particle in intimate contact with the oxidizer material particle.

20. An autoignition material of a plurality of agglomerates, each agglomerate consisting essentially of;

an oxidizer material particle, said oxidizer material including silver nitrate and having an average particle size of about 10 microns to about 100 microns;

a plurality of molybdenum fuel particles having an average particle size substantially smaller than the average particle size of the oxidizer material particle, the molybdenum fuel particles being disposed on the oxidizer material particle, the molybdenum fuel particles being present in a weight ratio effective to substantially stoichiometrically balance the oxidizer material particle and exothermically reacting with the oxidizer material particle when the autoignition material is exposed to a temperature of about 80° C. to about 250° C.; and a thin binder film adhering the molybdenum fuel particles to the oxidizer material particle and maintaining the molybdenum fuel particles in intimate contact with the oxidizer material particle, said binder being present in an amount of about 0.1% to about 1.5% by weight, based on the combined weight of the molybdenum metal fuel and the oxidizer material.

21. An autoignition material of a plurality of agglomerates, each agglomerate consisting essentially of;

a silver nitrate particle having an average particle size of about 10 microns to about 100 microns;

a plurality of molybdenum fuel particles having a average particle size substantially smaller than the average particle size of the silver nitrate particle, the molybdenum fuel particles being disposed on the silver nitrate particle, the molybdenum fuel particles being present in a weight ratio effective to substantially stoichiometrically balance the silver nitrate particle and exothermically reacting with the silver nitrate particle when the autoignition material is exposed to a temperature of about 80° C. to about 250° C.; and a thin binder film adhering the molybdenum fuel particles to the silver nitrate particle and maintaining the molybdenum fuel particles in intimate contact with the silver nitrate particle, said binder being present in an amount of about 0.1% to about 1.5% by weight, based on the combined weight of the molybdenum fuel particles and the silver nitrate particle.

* * * * *